United States Patent [19]

Tidquist et al.

[11] Patent Number: 4,699,666

[45] Date of Patent: Oct. 13, 1987

[54] COMPOSITION AND METHOD FOR DE-INSTALLING ASBESTOS COATINGS

[75] Inventors: John C. Tidquist, Nitro, W. Va.; Herbert B. Weisberg, 1500 N.W. 62nd St., Ft. Lauderdale, Fla. 33309

[73] Assignee: Herbert B. Weisberg, Ft. Lauderdale, Fla.

[21] Appl. No.: 849,851

[22] Filed: Apr. 9, 1986

[51] Int. Cl.[4] ..... B08B 7/00

[52] U.S. Cl. ..... 134/4; 134/6; 134/42; 106/287.23; 252/174.21; 252/174.22; 427/154

[58] Field of Search ..... 134/4, 42, 6; 252/174.21, 174.22; 106/287.23; 427/154

[56] References Cited

U.S. PATENT DOCUMENTS

| | | | |
|---|---|---|---|
| 4,347,150 | 8/1982 | Arpin | 134/4 |
| 4,529,449 | 7/1985 | Baustert et al. | 134/4 |
| 4,548,729 | 10/1985 | Schmid et al. | 252/174.22 |
| 4,632,847 | 12/1986 | Lomasney et al. | 134/4 |
| 4,647,314 | 3/1987 | Mullins et al. | 134/30 |

FOREIGN PATENT DOCUMENTS

| | | | |
|---|---|---|---|
| 6150474 | 4/1980 | Japan | 134/4 |
| 1525465 | 12/1974 | United Kingdom | 134/4 |

*Primary Examiner*—Asok Pal

*Attorney, Agent, or Firm*—Anthony S. Zummer

[57] ABSTRACT

A debilitant composition of water and a homopolymer of ethylene oxide having a molecular weight of from about 100,000 to about 5,000,000 and having a repeating monomeric unit with a molecular weight of 44 is applied to a body of previously installed asbestos insulation in sufficient quantity to thoroughly wet at least the exposed portion thereof. Thereafter, the pre-wet body is mechanically debrided.

5 Claims, No Drawings

COMPOSITION AND METHOD FOR DE-INSTALLING ASBESTOS COATINGS

FIELD OF THE INVENTION

This invention relates generally to the building construction arts, more particularly to the use of asbestos as fireproofing and heat insulation, and specifically to the de-installation of unwanted asbestos coatings from building structures.

BACKGROUND OF THE INVENTION

For many years, asbestos coatings were applied to otherwise exposed, structural steel building components, such as columns and joists for example, in order to protect the strength and integrity of these components in the event of fire. The coatings themselves commonly comprised asbestos fibers, infusorial earth or the like, and a binder material such as sodium silicate or Portland cement. However, modern building practices recognize the health hazard of exposed surfaces comprising asbestos as a potential source of dangerous airborne asbestos particles. Accordingly, a variety of sealants have been developed in the past for use in establishing a non-shedding surface on the asbestos-coated structures. More recently, programs have been initiated for the total removal of all exposed asbestos coatings from public buildings such as schools, hospitals and sports arenas; and the removal procedures which have been practiced heretofore have comprised the steps of wetting down the in-place, asbestos installation with water, scraping away the loosened portion of the coating material, rewetting the newly-exoposed surface, re-scraping and then repeating the cycle until removal was accomplished. However, applicant have found that this latter procedure is unnecessarily time-consuming and costly in that repeated rewetting is required to complete the removal project.

Accordingly, a general object of the present invention is to provide a new and improved debilitant composition and a method for using the same in facilitating the de-installation of asbestos insulation coatings.

Another object of the invention is to provide a debilitant composition having an advantageously low evaporation rate.

Still another object of the invention is to provide a debilitant composition that is easy to apply, has deep penetration power, and is not adversely affected by the inorganic ions normally encountered in use.

These and other objects and features of the invention pertain to the particular materials and procedures whereby the foregoing objects are attained.

DETAILED DESCRIPTION OF THE INVENTION

According to the method aspects of the present invention, a previously installed body of asbestos insulation is removed by first providing a debilitant composition of water and a homopolymer of ethylene oxide having a molecular weight of from about 100,000 to about 5,000,000 and having a repeating monomeric unit with a molecular weight of 44. Next, the previously installed body of asbestos insulation is treated with a sufficient quantity of the debilitant composition to cause thorough wetting of at least the exposed surface portion thereof, allowing the debilitant composition to penetrate the insulation body. Thereafter, the pre-wet body of insulation is mechanically debrided.

The specific homopolymer of ethylene oxide which is employed in the present invention, especially when combined with water, has been found to possess unusual affinity for the silicate mineral fibers of asbestos; and while it is not desired to be limited to any particular theory, it is believed that the poly(ethylene oxide) of the invention forms strong electrical bonds with molecules of water and that the resultant moieties, in turn, form linkages with the hydroxy groups which are known to reside on the surface of individual asbestos fibers, whereby to promote deep penetration into, and holding of waer within the asbestos matrix. In addition, it has been found that the poly(ethylene oxide) of the invention is not precipitated or inactivated by the inorganic ions normally encountered in use of the instant debilitant composition, for example such inorganic cations as calcium and magnesium.

The instant homopolymer of ethylene oxide is formulated in the present debilitant composition in an amount of from about 0.1% to about 5.0% by weight of the total composition; and the remainder is selected to be water or a combination of water and an organic humectating agent selected from the class consisting of ethylene, diethylene, propylene and hexalene glycol; glycerol; water-miscible alcohols such as ethanol and isopropanol; and such ketones as acetone. A preferred organic humectating agent is propylene glycol; and a pharmaceutical grade of this material is usefully employed for its low toxicity. Advantageously, the humectating agent is present in the debilitant composition in an amount of from about 0.03% to about 25% by weight.

While useful debilitant compositions according to the invention may employ ethylene oxide homopolymers having a molecular weight of from 100,000 to 5,000,000, a material in the lower molecular weight end of the range is generally preferred in order that the resultant composition may be a liquid having a viscosity of from about 30 to about 40 centipoises. So composed, the composition may be readily applied to the asbestos insulation that is to be de-installed, by means of conventional spraying equipment and methods.

One eminently useful formulation for the debilitant composition of the invention, comprising a working example thereof, is as follows:

| | Per Cent By Weight |
|---|---|
| Polyox WSR-N10 [poly(ethylene oxide)] | 3 |
| propylene glycol | 9 |
| water | 88 |
| | 100% |

The foregoing material was applied to the exposed, asbestos-coated ceiling and columns of a school-building using a conventional, airless paint sprayer operating at a maximum tank pressure of 500 p.s.i. The asbestos-coated surfaces were thoroughly wet with the sprayed liquid and were then allowed to stand for about 30 minutes to permit the debilitant to penetrate the asbestos coating. Thereafter, hand scraping tools were used by the work crew to de-install the asbestos composition. It was noted that the applied liquid rapidly wet the asbestos and softened the coating, making the removal task comparatively easy. Furthermore, the liquid did not quickly evaporate from the stripped clumps and thus suppressed a potential hazard from asbestos dust. Moreover, it was found that asbestos coatings treated with the instant debilitant composition stayed wet for up to five days after application and did not require rewetting in the event that the job was halted temporarily.

The specific example herein set forth is to be considered as being primarily illustrative. Various changes beyond those described will, no doubt, occur to those skilled in the art; and such changes are to be understood as forming a part of this invention insofar as they fall within the spirit and scope of the appended claims.

The invention is claimed as follows:

1. A method of removing a previously installed body of asbestos insulation which comprises the steps of: providing a debilitant composition of water and a homopolymer of ethylene oxide having a molecular weight of from about 100,000 to about 5,000,000 and having a repeating monomeric unit with a molecular weight of 44; treating a said body of previously installed asbestos insulation with a sufficient quantity of said composition to thoroughly wet at least the exposed portion of said body; and mechanically debriding said treated body.

2. A method according to claim 1 wherein said debilitant composition further includes an organic humectating agent.

3. A method according to claim 2 wherein said organic humectating agent is propylene glycol.

4. A method according to claim 1 wherein said debilitant composition is a liquid having a viscosity of from about 30 to about 40 centipoises and wherein said treatment is by spraying.

5. A method according to claim 1 wherein said homopolymer is present in said debilitant composition in an amount of from about 0.1% to about 5.0% by weight.

* * * * *

UNITED STATES PATENT AND TRADEMARK OFFICE

CERTIFICATE OF CORRECTION

PATENT NO. : 4,699,666

DATED : October 13, 1987

INVENTOR(S) : John C. Tidquist and Herbert B. Weisberg

It is certified that error appears in the above-identified patent and that said Letters Patent are hereby corrected as shown below:

Column 2, line 14, cancel "waer" and substitute therefor --water--

Signed and Sealed this

Twenty-third Day of February, 1988

*Attest:*

DONALD J. QUIGG

*Attesting Officer*

*Commissioner of Patents and Trademarks*